US006705561B2

(12) United States Patent
Mausser et al.

(10) Patent No.: US 6,705,561 B2
(45) Date of Patent: Mar. 16, 2004

(54) PROCESS AND DEVICE FOR CONTINUOUS REELING OF A PULP SHEET

(75) Inventors: Wilhelm Mausser, Graz (AT); Gerald Schadler, Vasoldsberg (AT)

(73) Assignee: Andritz AG, Graz (AT)

( * ) Notice: Subject to any disclaimer, the term of this patent is extended or adjusted under 35 U.S.C. 154(b) by 0 days.

(21) Appl. No.: 10/047,961

(22) Filed: Jan. 16, 2002

(65) Prior Publication Data

US 2002/0104917 A1 Aug. 8, 2002

(30) Foreign Application Priority Data

Jan. 22, 2001 (AU) ..... 103/2001
Nov. 9, 2001 (AU) ..... 1767/2001

(51) Int. Cl.[7] ..... B65H 18/16

(52) U.S. Cl. ..... 242/541.1; 242/541.7; 242/542.3

(58) Field of Search ..... 242/541.1, 541.7, 242/542.3, 539, 548, 913

(56) References Cited

U.S. PATENT DOCUMENTS

| | | | | | |
|---|---|---|---|---|---|
| 3,687,388 | A | * | 8/1972 | Pfeiffer | 242/534 |
| 3,877,654 | A | * | 4/1975 | Randpalu et al. | 242/533.1 |
| 5,611,500 | A | * | 3/1997 | Smith | 242/541.4 |
| 5,664,737 | A | * | 9/1997 | Johnson et al. | 242/541.1 |
| 5,845,868 | A | * | 12/1998 | Klerelid et al. | 242/541 |
| 6,029,927 | A | * | 2/2000 | Wohlfahrt et al. | 242/527.2 |
| 6,036,137 | A | * | 3/2000 | Myren | 242/541.7 |
| 6,250,580 | B1 | * | 6/2001 | Madrzak et al. | 242/533.2 |

* cited by examiner

*Primary Examiner*—Kathy Matecki
*Assistant Examiner*—Sang Kim
(74) *Attorney, Agent, or Firm*—Alix, Yale & Ristas, LLP

(57) ABSTRACT

A process for continuous reeling of a pulp sheet, particularly a paper sheet, where the sheet runs over a reel drum and is later wound on a winding unit. The pressing force in the nip between the horizontal reel and the reel drum is measured without any losses.

7 Claims, 6 Drawing Sheets

PROCESS AND DEVICE FOR CONTINUOUS REELING OF A PULP SHEET

BACKGROUND OF THE INVENTION

The invention relates to a process and a device for continuous reeling of a pulp sheet, particularly a paper sheet, e.g. tissue, where the sheet runs over a reel drum and is later wound on a winding unit.

Processes and devices of this kind have been known for some time in the production of paper sheet. The disadvantage of the devices known is that either the contact pressure of the horizontal reel on the reel drum is such that the horizontal reel is driven by the force generated by friction, as shown by U.S. Pat. No. 5,611,500 A (Smith) or U.S. Pat. No. 5,845,868 A (Klerelid et al.), or a separate drive is provided for the horizontal reel, as in DE 197 48 995 A1 (Voith), where the pressing force cannot be set exactly because there are too many points where non-calculable losses arise, e.g. due to friction. The pressure pre-set at the contact pressure cylinders thus does not define the actual pressing force between reel drum and horizontal reel. Low pressing force is desirable in particular for tissue with a high volume in order to avoid destroying the high volume again with the contact pressure. In the conventional devices known, however, the pressing force can only be set imprecisely and the losses due to friction in the mechanical parts already exceed the required contact pressure, thus it is impossible to control the pressing force exactly.

SUMMARY OF THE INVENTION

The aim of the invention is to propose a process and a device that are easy to control during the winding process, even at low contact pressures.

The invention is thus characterized by the pressing force in the nip between the horizontal reel (core shaft) and reel drum being measured without any losses. Since the measurement is taken without any losses, the contact pressure can always be determined exactly and adjusted continuously.

An advantageous further development of the invention is characterized by the reading measured for the pressing force being used to control the pressing force at a desired level. Thus, it is also possible to set a low pressing force.

An advantageous configuration of the invention is characterized by the pressing force and the regulating distance being controlled by a measuring system integrated into the pressure cylinders that generate the contact pressure.

A favorable further development of the invention is characterized by the pressing force at the reel drum being measured in the direction of the force. As a result, the influence of friction and any influence on the measurement reading by the unbalanced mass of the paper roll can be eliminated.

If the load-sensing device is pre-stressed, sustained contact is guaranteed between oscillating lever and load-sensing device.

If the pressing force is measured horizontally in an advantageous configuration of the invention, this guarantees that also any weight influences, which otherwise always have to be taken into account separately, are eliminated.

In a favorable further development of the invention, a pre-set pressing force in the nip is transferred via the paper roll to the reel drum by the hydraulic cylinders for the secondary arms, while the force applied by the hydraulic cylinders can be adapted continuously on the basis of the measurement readings from the load-sensing device and the pressing force in the nip can preferably be maintained at a constant level. As a result, it is possible to achieve a low pressing force and, in consequence thereof, maintain the volume, particularly with high-volume tissue paper.

The invention also refers to a device for implementing the process, with a reel drum and a horizontal reel, characterized by load-sensing devices being provided for measuring the nip force without losses. Since the measurement is taken without any losses, the contact pressure can always be determined exactly and continuously adjusted, even with low contact pressures.

A favorable further development of the invention is characterized by the horizontal reel being supported on load-sensing devices, preferably throughout the entire reeling process. As a result, it is possible to measure the contact pressure directly and without any losses, while guaranteeing uniform paper quality right through the entire reeling process.

An advantageous further development of the invention is characterized by the load-sensing devices being provided in a horizontally adjustable holding device. In this way, it is possible to guarantee a constant force direction and simple transfer of the (controlled) pressing force.

An advantageous configuration of the invention is characterized by the horizontally adjustable holding device being provided with support rollers that run in guide units, where the guide units are sealed off by a vertically arranged moving belt. This ensures safe and low-friction adjusting, which permits the contact force to be adapted precisely, even at low values.

A favorable further development of the invention is characterized by the endless belt being made of woven fabric, synthetic material or steel. In this way, the most favorable solution can be sought in each case depending on the requirements and environment.

An advantageous further development of the invention is characterized by the vertically arranged moving belt being a continuous loop running round two rolls provided at the ends of the guide units. This arrangement provides a frictionless seal.

A favorable configuration of the invention is characterized by the deflection rolls having trapezoidal grooves to guide the belt, with the endless-woven belt at least having a trapezoidal profile that meshes into the trapezoidal grooves in the deflection rolls. This permits very good lateral belt guiding, where there can be no friction losses and the belt cannot run off track to the side.

A favorable further development of the invention is characterized by the reel drum being supported on vertical oscillating levers and a load-sensing device being inserted between the oscillating levers and a fixed counterpart. In this way, the influence of friction and any influence on the measurement reading by the unbalanced mass of the paper roll can be eliminated.

If the oscillating levers have tensioning elements that press these levers against the load-sensing device, sustained contact can be guaranteed between oscillating lever and load-sensing device. This also guarantees a continuous signal for a control device.

Here the tensioning elements can be mechanical with, for example, springs, or hydraulic or pneumatic with, for example, cylinders.

If the load-sensing device is mounted firmly in horizontal direction in the horizontal plane of the reel drum axis, this guarantees that also any weight influences, which otherwise always have to be taken into account separately, are eliminated.

With all of these measures, it is possible to guarantee exact measurements and maintain the contact pressure at a constant level at virtually any stage of the reeling process.

By inserting the load-sensing device at the fixed reel drum, exact measuring is always guaranteed, even if a roll (horizontal reel) is changed. This precision is not ensured in other known systems due to the time factor pressure during roll change, which often results in inexact work, and due to the resulting additional, non-calculable friction influence.

BRIEF DESCRIPTION OF THE DRAWINGS

The invention will now be described in examples and referring to the drawings, where.

DETAILED DESCRIPTION OF THE PREFERRED EMBODIMENT

Figure 1:
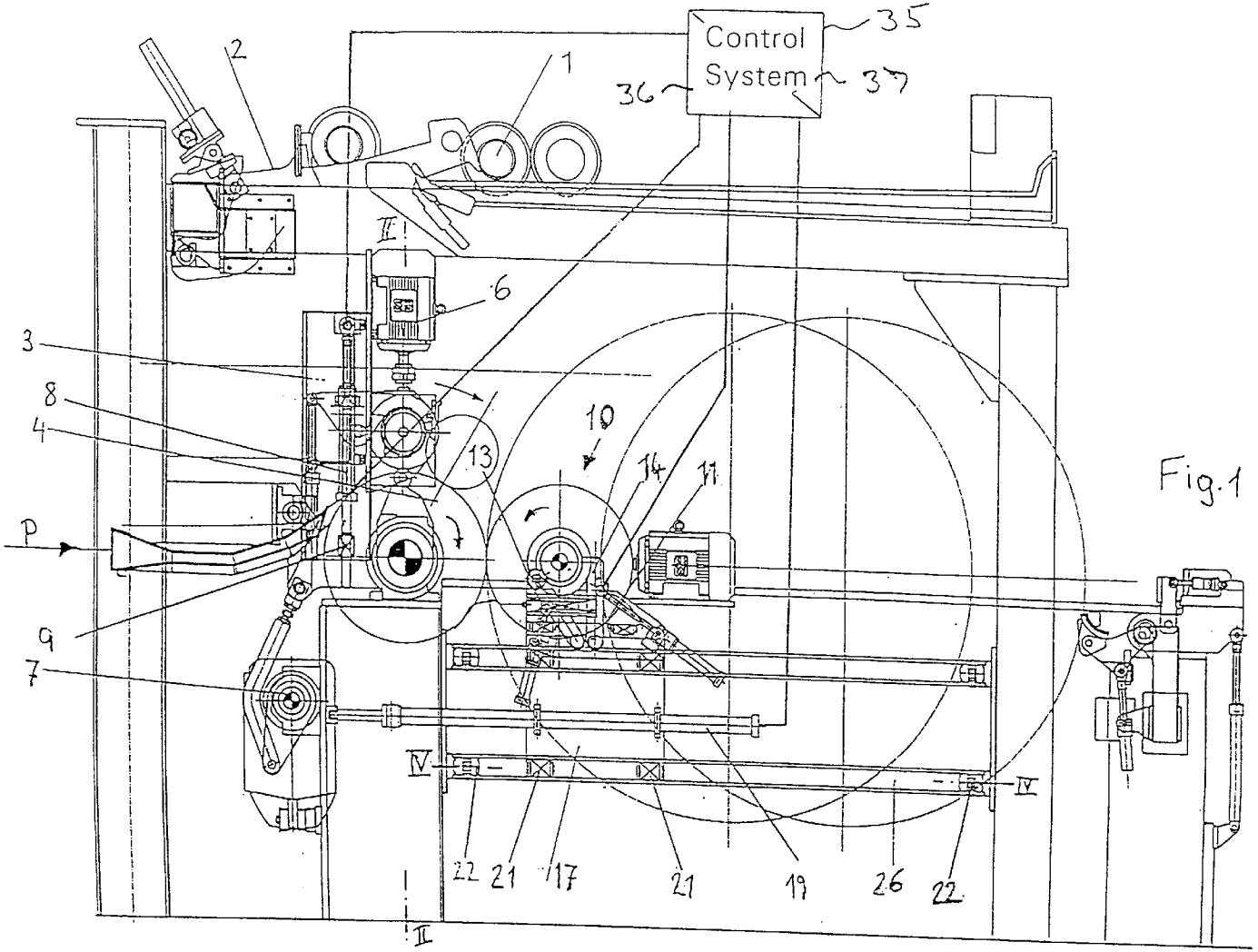
FIG. 1 shows a plant according to the invention.

The action of the device will now be described with the help of FIG. 1. The core shaft (horizontal reel) 1 is placed in the primary arm 3 using a lowering device 2 and clamped in place hydraulically in a vertical position above the reel drum 4. On the front side, FS, there is a gear motor 6 installed on a mounting plate and which is movable in axial direction. This motor is coupled to the core shaft 1 to bring the shaft up to machine speed.

A swivelling device 7 now turns the primary arm 3 round the axle of the reel drum 4 until the core shaft 1 is resting on the drum. During this process the core shaft 1 takes hold of the paper web P over its entire width with the aid of a suitable device and begins winding it on, thus increasing its diameter. The pressing force needed between the core shaft 1 and the reel drum 4 is applied and controlled via hydraulic cylinders 8, which are fitted with a load-sensing device. Here, compensation of the weight of the core shaft 1 is also taken into account. The primary arm 3 is now swivelled further round the axis of the reel drum 4 until the core shaft 1 reaches a horizontal position. At the same time, the thickness of the paper roll increases continuously up to a maximum of 350 mm. During this process, the outer part of the primary arm 3 moves outwards telescopically. This arm runs on roller bearings 9 in order to keep the influence of friction on the nip force as low as possible. The paper roll is placed on a horizontally movable holding device 11 and clamped in.

Figure 2:
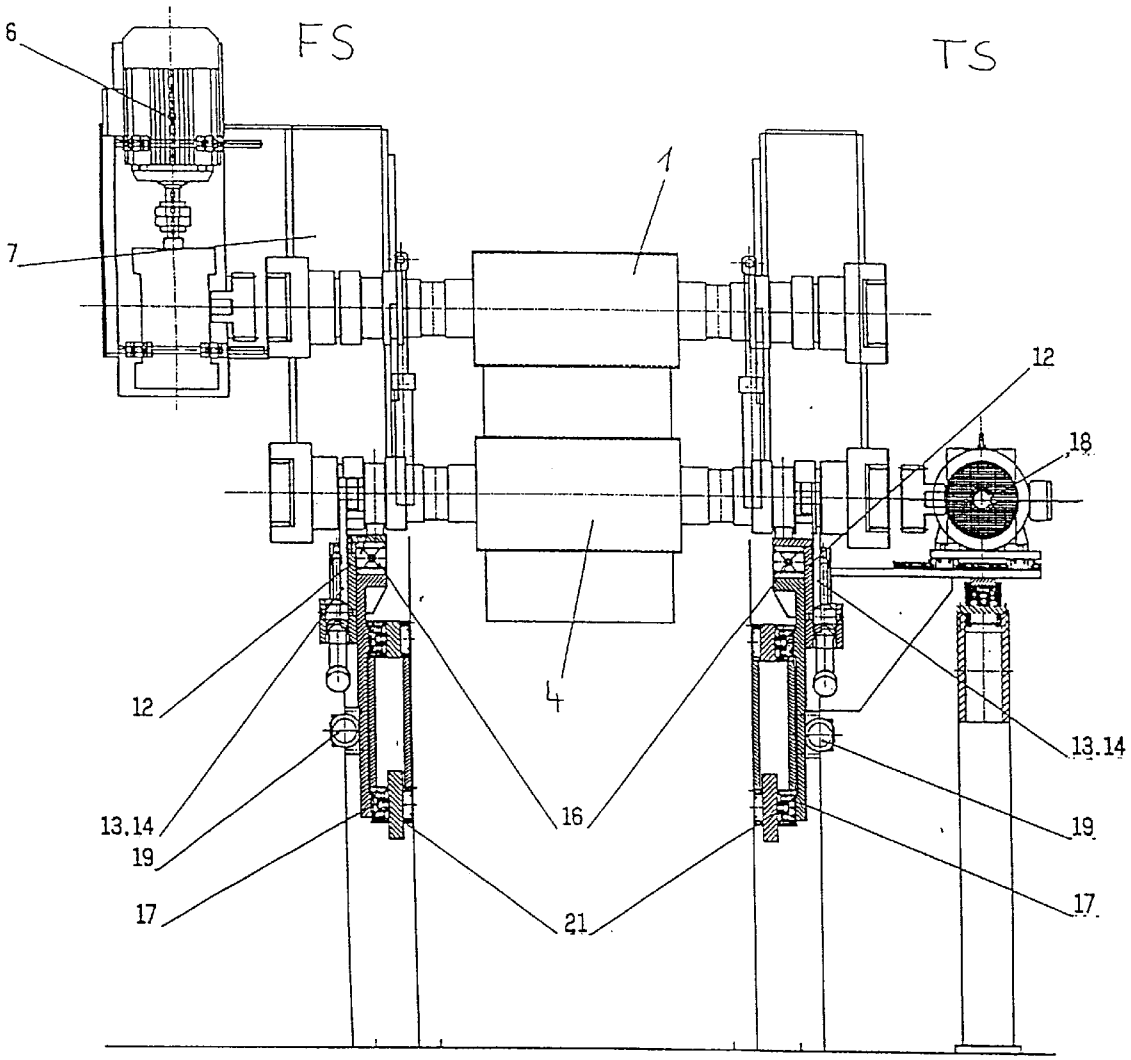
FIG. 2 shows a sectional view taken along the line II—II in FIG. 1, FIG. 3 contains an extract from FIG. 1.

FIG. 2 shows a sectional view taken along the line II—II in FIG. 1. The holding device 11 comprises a receiving part 12 with two hydraulically operated clamping levers 13, 14 and rests on a load-sensing device 16, which again is mounted on the movable part 17. The entire unit is also referred to as the secondary arm 10. On the rear side TS, a gear motor 18 that is movable in axial direction is connected to the holding device 11. As soon as the paper roll is horizontal, this drive 18 on the rear side TS is connected to the core shaft 1 and the drive 6 in the primary arm 3 is disconnected. In the further winding process the horizontal nip force (pressing force between horizontal reel 1 and reel drum 4) is generated via the secondary arm 10 with one hydraulic cylinder 19 on both the front side FS and rear side TS and controlled using a load-sensing device.

As the winding process continues in the secondary arm 10, the next core shaft 1 is prepared in the primary arm 3. As soon as the paper reel has obtained the desired size, it is pulled away from the reel drum 4, the new core shaft 1 in the primary arm 3 is placed in the initial winding position on the reel drum 4 and the full width of the paper web P is now wound onto this new core shaft. When the finished paper roll has been ejected from the secondary arm 10, this arm moves back to the reel drum 4 and then receives the new core shaft 1 from the primary arm 3. The load-sensing devices 16 are designed such that they only measure the horizontal forces actually applied in the nip between the horizontal reel 1 and the reel drum 4. Vertical components from the drives or from the changing own weight of the paper roll do not influence the values measured. The measured value signals recorded control the movement of the two hydraulic cylinders 19 in order to ensure that the secondary arms 10 are running absolutely parallel on the front FS and rear TS sides, and to guarantee a pre-selected nip force progression (constant or changing) through the entire winding process. The moving part 17 of the secondary arm 10 is supported on horizontal rollers 21, which in turn run in guide units 26 in order to keep the influence of friction low here as well.

Figure 3:
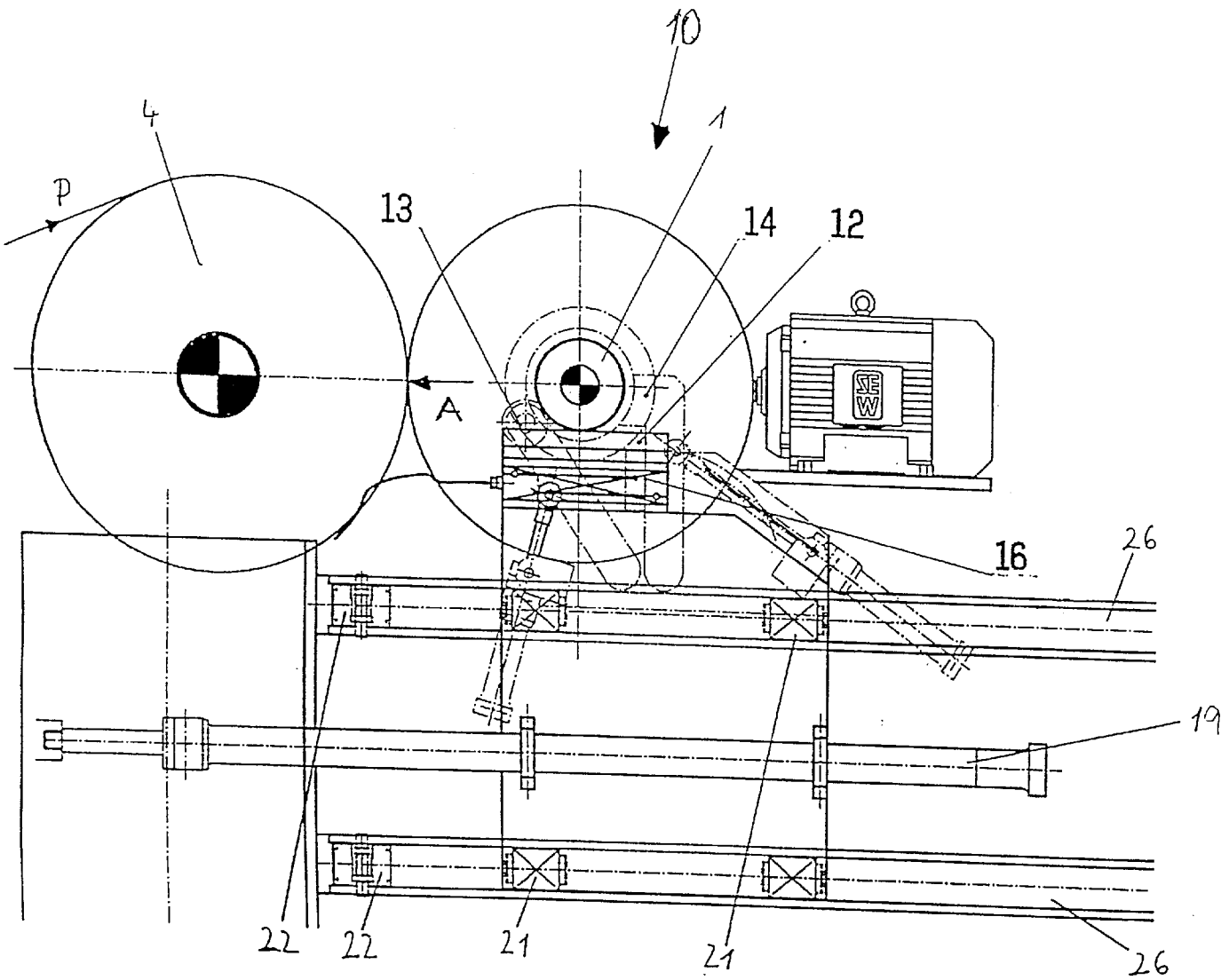

FIG. 3 now shows an extract from FIG. 1, showing the secondary arm 10. Here it is possible to make out reel drum 4 and core shaft 1 with a partially wound paper roll. The pressing force A can be measured via load-sensing device 16 without losses and regardless of the position because there are no intermediate elements to cause losses. During the winding process, the movable part 17 of the secondary arm 10 is displaced by the hydraulic cylinders 19 in such a way that the pressing force A of the core shaft 1 acting on the reel drum 4 is always the same. The respective position of the secondary arm 10 is recorded here by measuring systems integrated into the cylinders 19.

In order to avoid destroying the volume of the paper web P, very low pressing forces (down to a minimum of approx. 0.1 N/mm) are applied. The movable part 17 can be displaced with very low friction losses using the support rollers 21.

Figure 4:
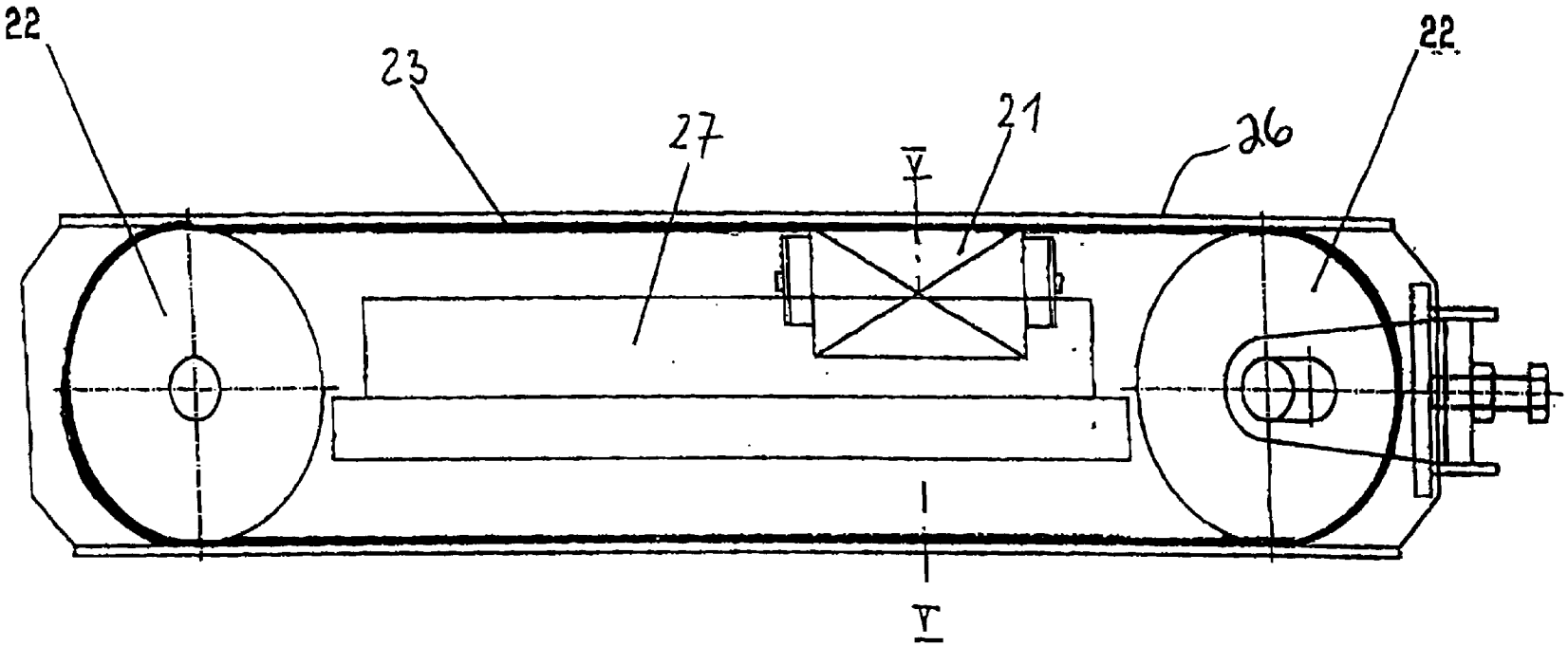
FIG. 4 is a sectional view taken along the line IV—IV in FIG. 1.

These support rollers 21 are protected against dirt accumulations by a special device, which is shown in FIG. 4 (sectional view taken along the line IV—IV in FIG. 1). It consists of two deflection rolls 22 per guide unit 26 (8 deflection rolls in total for one plant), where one roll 22 can be tensioned. An endless woven belt 23 made of fabric, plastic or steel runs round the deflection rolls 22. The support rollers 21 are secured to this belt 23, however only one support roller 21 is shown here as an example.

Figure 5:
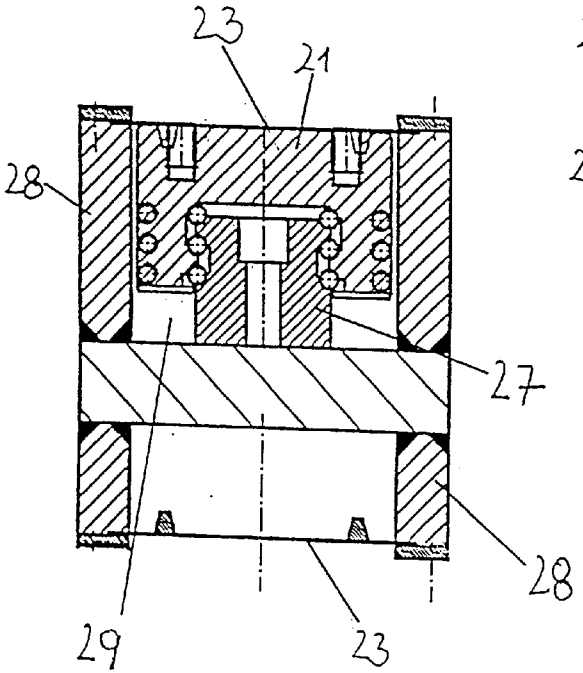
FIG. 5 is a sectional view taken along the line V—V in FIG. 4.

FIG. 5 now shows a sectional view taken along the line V—V in FIG. 4, where the structure of the support rollers 21 is visible. The support rollers 21 run here on rails 27. The surfaces 28 of the guide unit 26 are visible on the top and underside. This illustration also shows the endless woven belt 23, to which the support rollers 21 are attached and which also moves along close to the wall surfaces 28 of the guide unit 26 on the other side.

Figure 6:
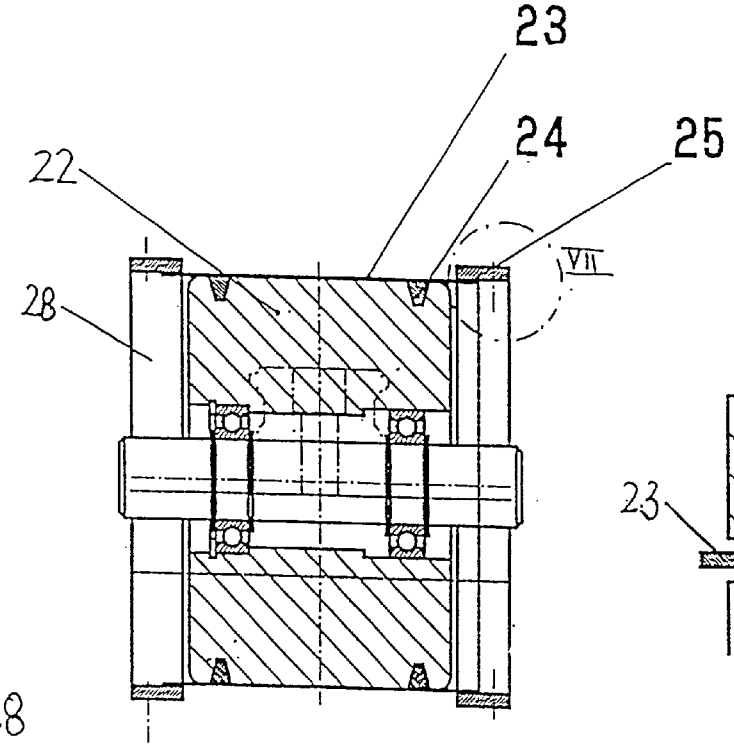
FIG. 6 is a sectional view taken along the line VI—VI in FIG. 4.

FIG. 6 shows a sectional view taken along the line VI—VI in FIG. 4, which runs through a deflection roll 22. The deflection rolls 22 have two trapezoidal grooves, for example, with two trapezoidal guide profiles 24 also being provided on the endless woven belt 23, for example, which mesh into the grooves in the deflection rolls 22 and thus, prevent the belt from running off track to the side. The number of grooves may vary depending on the belt width.

Figure 7:
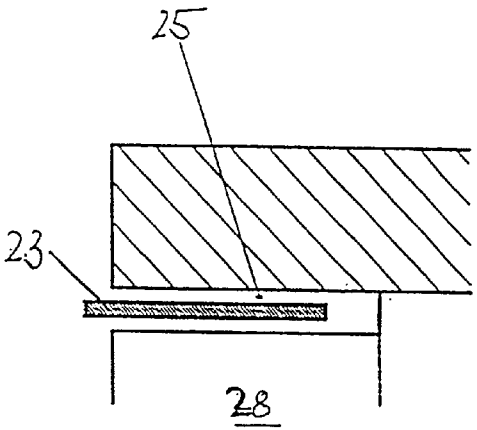
FIG. 7 is an extract as encircled in VII in FIG. 6.

FIG. 7 shows an extract VII from FIG. 6. This illustration clearly shows lateral slots 25 in the wall 28 of the guide unit 26, which are used to guide the belts 23 and as seals. In addition, the void 29 created by this device is protected against dust entering by the constant supply of compressed air blown in.

Figure 8:
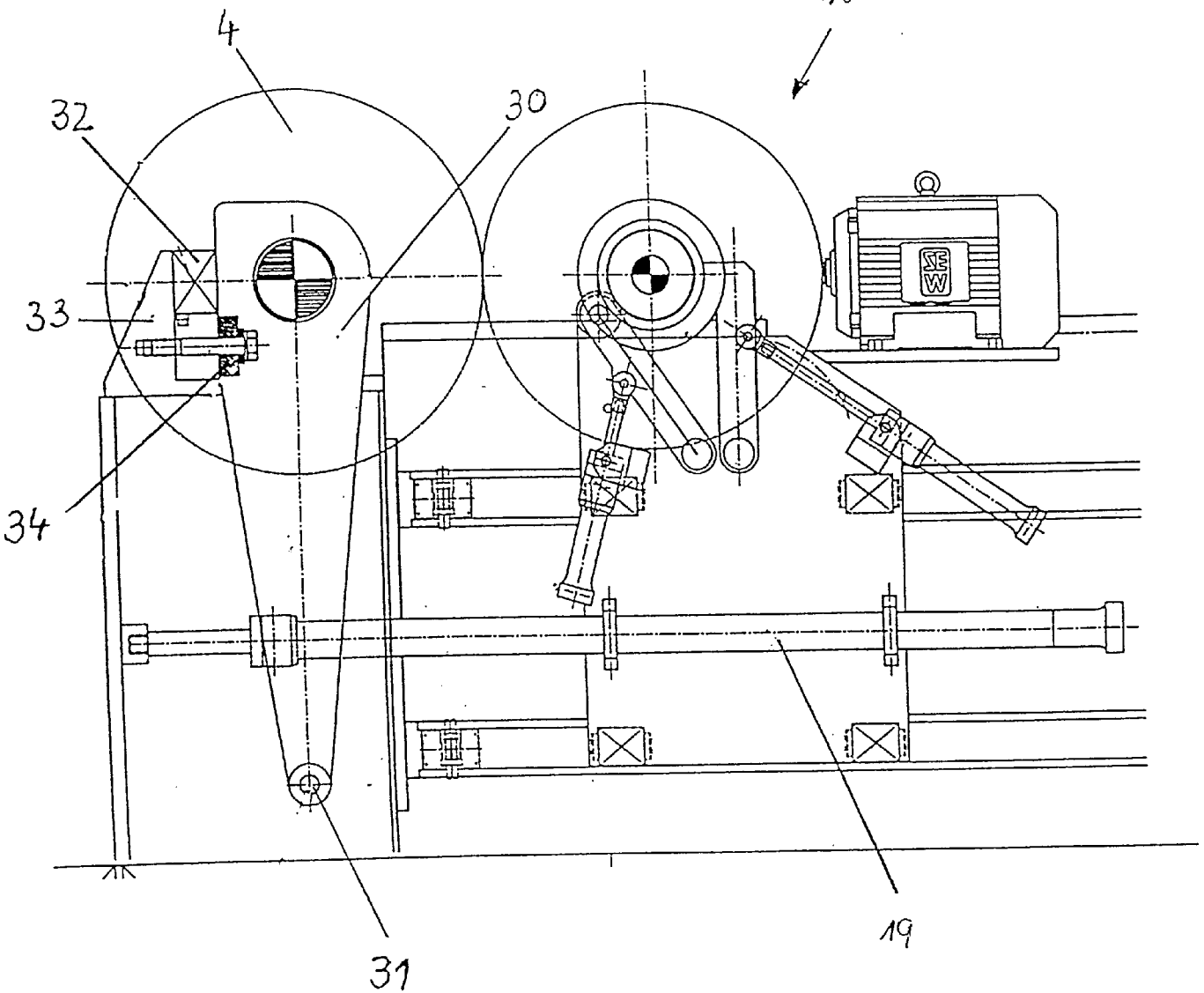
FIG. 8 is an extract from a variant of the invention similar to FIG. 3.

FIG. 8 shows the bearing assembly and load sensing in detail for a further variant of the invention. The reel drum 4 is supported on vertical swivelling levers 30 which are pivoted around bolts 31. The load-sensing devices 32 are clamped in the horizontal plane of the reel drum 4 between the swivelling levers 30 and a fixed counterpart 33, where the swivelling levers 30 are provided with tensioning elements 34, which are operated either mechanically (e.g. springs), hydraulically or pneumatically (cylinders) and which always press against the load-sensing device. After the swivelling levers 30 have been tensioned, the load-sensing devices 32 are calibrated to nip force 0. After this, a pre-selected nip force is transferred via the paper roll to the reel drum 4 by the hydraulic cylinders (or pneumatic cylinders (19)) of the secondary arms 10. This force is measured by the load-sensing devices 32 and the measuring result used to control the hydraulic cylinders 19.

This arrangement avoids any distortion of the measuring results due to the influence of friction, as is caused, for example, by cylinder seals or lateral friction due to the bearing housings rolling on rails. In addition, the unbalanced mass of the paper roll has no influence whatsoever on the measuring results, which otherwise is unavoidable if the horizontal reel is supported directly on measuring devices. Thus, the nip force can be measured and controlled very well and very accurately, even at very low contact pressures.

It should be appreciated that the control system 35 preferably includes two circuits 36, 37. The first circuit 36 connects the sensing device in the primary arm 3 with the respective pressure cylinders) 8. The second circuit 37 connects the sensing device 16 in the secondary arm 10 with the pressure cylinder(s) 19. Since the pressure force should be constant also between the primary and secondary arms 3, 10, both circuits 36, 37 are preferably connected in the same control system 35.

The invention is not limited to the examples shown. In addition to hydraulic cylinders, it is also possible to use, for example, pneumatic cylinders.

What is claimed is:

1. Apparatus for continuously reeling a pulp sheet comprising:

a horizontal reel adapted for having the pulp sheet wound thereon;

a reel drum defining a nip with the horizontal reel and being adapted for providing a nip force pressing the pulp sheet onto the horizontal reel;

a plurality of load sensing devices, the load sensing devices measuring the nip force without losses; and a horizontally adjustable holding device including a plurality of guide units, each guide unit extending horizontally from a first end to a second end, at least one support roller disposed within each guide unit, the support roller being adapted for supporting the horizontal reel and pulp sheet wound thereon, and a plurality of endless belts, one of the endless belts sealing the associated guide unit;

wherein the load sensing devices are disposed within the holding device and the horizontal reel and pulp sheet wound thereon are supported on the load-sensing devices.

2. Apparatus according to claim 1 wherein the endless belt is composed of woven fabric, synthetic material or steel.

3. Apparatus according to claim 1 wherein the holding device further includes first and second deflection rolls rotatably mounted at the first and second ends of each guide unit, one of the endless belts rotatably running around the first and second deflection rolls of each guide unit.

4. Apparatus according to claim 3 wherein for at least one guide unit, the associated first and second deflection rolls each define at least one circumferential trapezoidal groove and the associated endless belt has a longitudinally extending trapezoidal guide profile that is received in the trapezoidal grooves of the deflection rolls.

5. Apparatus for continuously reeling a pulp sheet, comprising:

a horizontal reel adapted for having the pulp sheet wound thereon;

a reel drum defining a nip with the horizontal reel and being adapted for providing a nip force pressing the pulp sheet onto the horizontal reel;

a plurality of load sensing devices, the load sensing devices measuring the nip force without losses;

a plurality of swivelable levers; and a plurality of fixed counterparts;

wherein a one of the fixed counterparts is associated with each lever, the reel drum is supported on the levers and one of the load-sensing devices is disposed between each lever and associated fixed counterpart.

6. Apparatus according to claim 5 further comprising a plurality of tensioning elements, one of the tensioning elements pressing each of the levers against the associated load-sensing device.

7. Apparatus according to claim 5 wherein the reel drum has an axis and the load-sensing device is fixedly mounted in a horizontal plane extending through the reel drum axis.

* * * * *

UNITED STATES PATENT AND TRADEMARK OFFICE

CERTIFICATE OF CORRECTION

PATENT NO. : 6,705,561 B2
DATED : March 16, 2004
INVENTOR(S) : Mausser et al

It is certified that error appears in the above-identified patent and that said Letters Patent is hereby corrected as shown below:

Title page,
Item [30], Foreign Application Priority Data, after "Jan.22, 2001", delete "(AU)" and replace with -- (AT) --; and after "Nov. 9, 2001", delete "(AU)" and replace with -- (AT) --.

Signed and Sealed this

Thirteenth Day of July, 2004

JON W. DUDAS
*Acting Director of the United States Patent and Trademark Office*